US005856767A

United States Patent [19]

D'Oro et al.

[11] Patent Number: 5,856,767

[45] Date of Patent: Jan. 5, 1999

[54] DC BIAS DEVICE FOR HIGH POWER, LOW INTERMODULATION RF-SYSTEMS

[75] Inventors: Enzo Cavalieri D'Oro, Monza; Massimo Rivolta, Agrate Brianza, both of Italy

[73] Assignee: Forem S.r.l., Italy

[21] Appl. No.: 660,163

[22] Filed: Jun. 3, 1996

[51] Int. Cl.[6] ..... H01P 1/00; H01P 5/00

[52] U.S. Cl. ..... 333/245; 333/260

[58] Field of Search ..... 333/104, 206, 333/245, 260, 262

[56] References Cited

U.S. PATENT DOCUMENTS

| | | | |
|---|---|---|---|
| 3,179,816 | 4/1965 | Hall et al. | 333/104 X |
| 3,197,720 | 7/1965 | Dehn | 333/206 |
| 4,087,767 | 5/1978 | Perkins | 333/245 X |

FOREIGN PATENT DOCUMENTS

| | | |
|---|---|---|
| 2571550 | 4/1986 | France . |
| 486130 | 5/1969 | Switzerland . |

OTHER PUBLICATIONS

M. M. McDermott et al., Very Broadband Coaxial dc Returns Derived by Microwave Filter Synthesis, The Microwave Journal, pp. 33–36, Feb., 1965.

*Primary Examiner*—Paul Gensler
*Attorney, Agent, or Firm*—Ostrolenk, Faber, Gerb & Soffen, LLP

[57] ABSTRACT

A DC bias device for radio-frequency transmission systems of high power and low intermodulation connected between an originating station and a receiving station for an RF signal fed along a transmission line. Direct current is supplied from a source to the transmission line along a branch joined to the transmission line at a junction formed between the originating station and the receiving station. An open-circuit stub is formed along the transmission line between the transmitting station and the junction. A short-circuit stub is formed along the DC-supply branch between the source and the junction to the transmission line. The impedance (Zop) of the open-circuit stub, and the distance of the free heads of the near ends of the two stubs preferably is as low as possible.

9 Claims, 4 Drawing Sheets

DC BIAS DEVICE FOR HIGH POWER, LOW INTERMODULATION RF-SYSTEMS

BACKGROUND OF THE INVENTION

1. Field of the Invention

This invention concerns a DC bias device for radio frequency transmission systems of high power and low intermodulation, comprising resonator circuits made up of stubs. More specifically, the invention relates to a BIAS-T system comprising a radio frequency (RF) transmitting station or source and a receiving station for the aforementioned RF which must be activated by DC power coming from an outside source and injected on the line between the two stations.

2. Description of the Related Art

A DC bias device is a circuit for introducing DC power from an outside source to a part of an RF circuit without altering its function. The working principle of a conventional DC bias device is illustrated schematically in FIG. 1. A radio frequency circuit is shown, consisting, for example, of an RF-signal transmitting station A, and an RF-signal receiving station B. A DC bias comes from a power source D. A block S ideally must be a short circuit in series for the RF signal, and block P an open circuit in series for the DC signal.

FIG. 2 shows emblematically the simplest embodiment of the scheme of FIG. 1: a capacitor C works as a high-pass filter, and an inductance L (in series with D) works as a low-pass filter, whereby a DC signal introduced in D can reach B through the co-axial line without involving A. The circuit of FIG. 2 can be used at relatively low frequencies, on the order of hundreds of MHz, and for power below tens of watts.

When, however, the frequency exceeds, for example, one GHz, and the power runs to hundreds of watts, the devices of the type shown in FIG. 2 are unsuitable and do not satisfy practical requirements, giving rise to various inconveniences, due to which more complex circuits are needed comprising specific elements such as resonators. Such resonators can be made, for instance, with stubs on the two branches of FIG. 2.

A stub generally is a co-axial short- or open-circuit. The device shown in FIG. 2, which is a co-axial version, can incorporate two stubs, and have a structure as shown in the equivalent schemes of FIGS. 3 and 4.

In these figures, an open-circuit resonator RS1 in series with A is made of an inductor L1 and a capacitor C1 in series with L1. The short-circuit resonator RS2 is made of L2 and C2 connected in parallel. In FIG. 4, the RS1 and RS2 resonators reach the junction N positioned on the co-axial line 1 between A and B. The RS1 and RS2 resonators must keep the impedance matched on the AB line.

Being a co-axial line, the resonators can take on the form of stubs with cavities, for example, in the inner co-axial conductor, formed respectively of an external co-axial conductor of a branch (for instance A) in which the cavity is formed, into which cavity is inserted a protuberance of the inside co-axial conductor of the branch B.

FIG. 5 shows a classic, schematic, partial cross-section of a resonator RS1 with a stub STU1. CE1 is the outer conductor of the co-axial line 1 between A and B. The inner co-axial conductor CI(A) has a cylindrical cavity CC, and an opening AP through which is inserted the protuberance PR1 of the inner conductor CI(B) of the branch B of the co-axial line 1 between A and B. The cavity CC is closed at its other extremity by a bottom 61.

The cavity CC in the internal conductor CI(A) and the protuberance PR1 of the inside conductor CI(B) together form a stub STU1 terminated in an open circuit (W-Z). In a narrow band, stub STU1 (forming the RS1 resonator) can be equivalently represented by the circuit L1, C1 of FIG. 3.

FIG. 6 shows another possible stub STU2 terminated with a short circuit for the RF and also formed by a cavity and a protuberance. The inner conductor CI2 (B) shows a protuberance PR2 which is closed in a short circuit on the bottom X-X' of the cylindrical cavity PCC connected to the outer conductor CE2 of the branch AB.

For the best functioning of the two stubs STU1 and STU2, taken singularly, it is recommended that the STU1 open-circuit stub in series on A-B (FIG. 5) have a characteristic impedance which is the lowest possible, in order to have, among other things, the least reflection.

If, however, the two stubs are used together, that is, combining the aforementioned stubs STU1 (series) and STU2 (parallel), to combine the features specified above, among other drawbacks, the following disadvantages which are extremely problematic to the combination occur:

- the two reflections not only are not eliminated but are even free to add to each other; and
- even if there was a matching, the compensation which might result would always be only partial.

Accordingly, the need exists for a DC bias device which does not have the aforementioned impediments, has simple constructional design, and is very reliable.

SUMMARY OF THE INVENTION

It has now been found that the drawbacks just mentioned are effectively eliminated with two critical, contemporary measures, as follows:

1. Giving to the parallel, short-circuit stub STU2 a characteristic normalized impedance Z' op equal to the characteristic normalized admittance of the series, open-circuit stub STU1, the admittance being the highest possible, compatible with the realization constraints; and
2. Putting the near ends of the two stubs at the lowest possible distance, in particular at a distance below $\lambda/100$ (where $\lambda$ corresponds to the central frequency F0 of the RF signal), the maximum of such a distance being below $\lambda/20$.

In effect, by not respecting the condition 1, for instance, by making, as is possible and immediate, the impedance of STU2 not correspond to the maximum admittance of STU1, in particular by making the impedance of STU1, (apparently more favorable) above the optimal value, the reflections occur which can easily combine with each other and cause a decided worsening of the characteristics.

As to the measure 2 (minimum distance) with increasing values from the minimum indicated ($\lambda/100$) one has first a reduction of the compensation followed by a rising increase in the total reflection, going up to the arithmetical sum of the two reflections for a distance of 80 /4, well outside the critical interval according to the invention.

The different aspects and advantages of the invention will be more clearly apparent from the description of the preferred embodiments illustrated in FIG. 7 which is a cross-section view of the DC bias device according to the invention, and in FIG. 8, a simplified representation on an enlarged scale which facilitates the ready understanding of FIG. 7.

Other features and advantages of the present invention will become apparent from the following description of the invention which refers to the accompanying drawings.

DETAILED DESCRIPTION OF THE PREFERRED EMBODIMENTS

Figure 1:
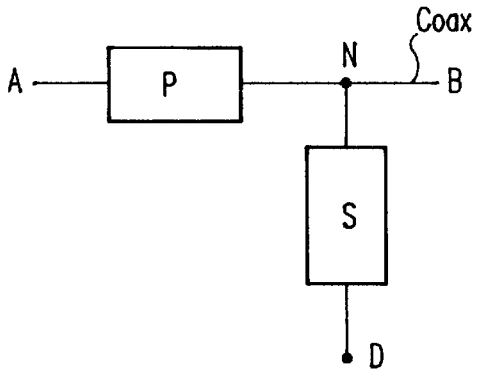
FIG.1 PRIOR ART
FIG. 1 shows a conventional DC bias device illustrated schematically.
Figure 2:
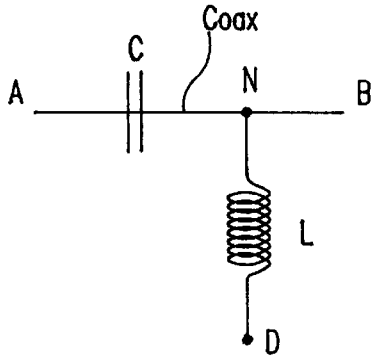
FIG.2 PRIOR ART
FIG. 2 shows a simple embodiment of the scheme of FIG. 1.
Figure 3:
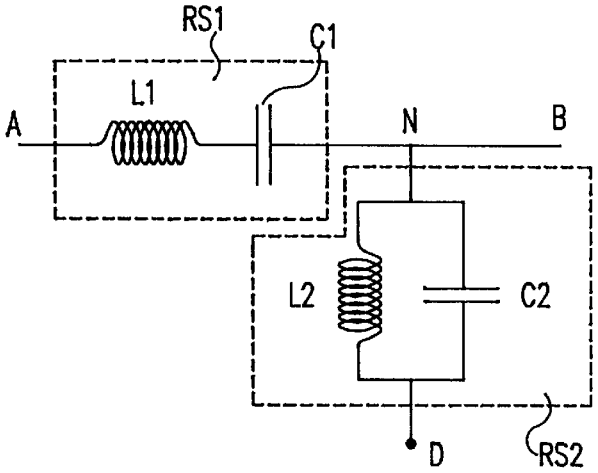
FIG.3 PRIOR ART
FIG. 3 Shows another embodiment of the circuit of FIG. 1.
Figure 4:
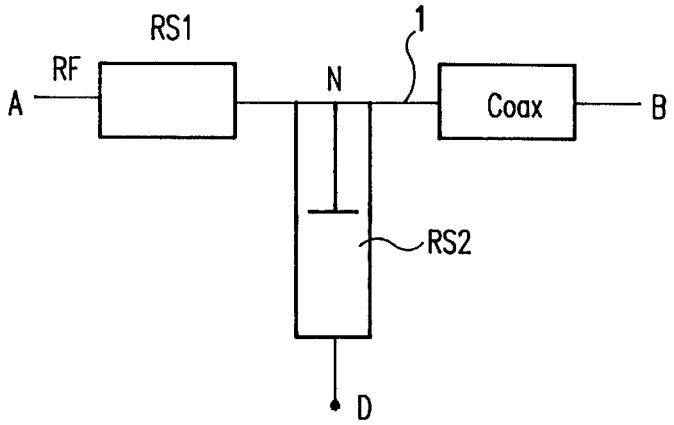
FIG.4 PRIOR ART
FIG. 4 shows a third embodiment of the circuit of FIG. 1.
Figure 5:
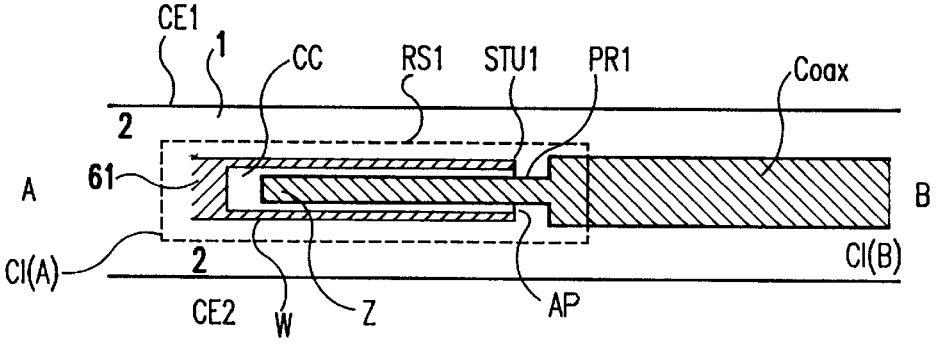
FIG.5 PRIOR ART
FIG. 5 is a detailed cross-section of a resonator with an open-circuit stub.
Figure 6:
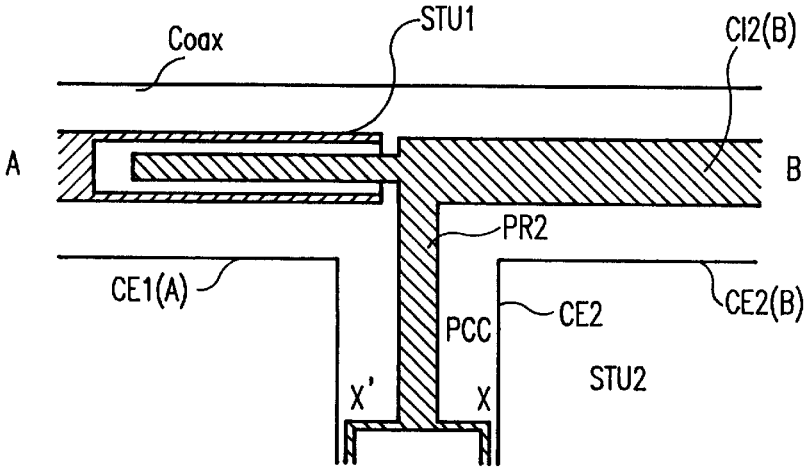
FIG.6 PRIOR ART
FIG. 6 As a detailed cross-section of another resonator with a short-circuit stub.
Figure 7:
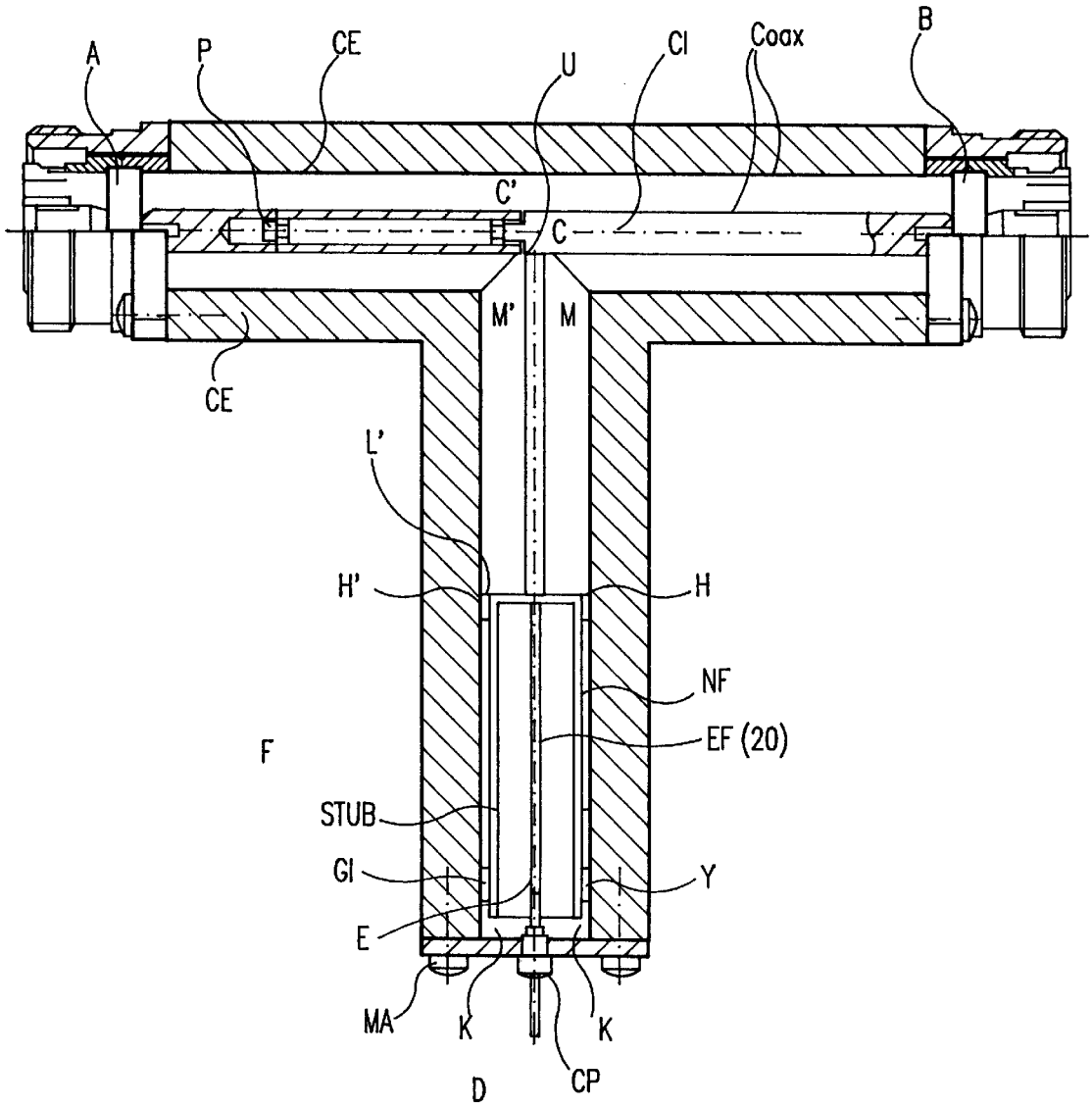
FIG. 7 is a cross-section view of a DC bias device according to the invention.
Figure 8:
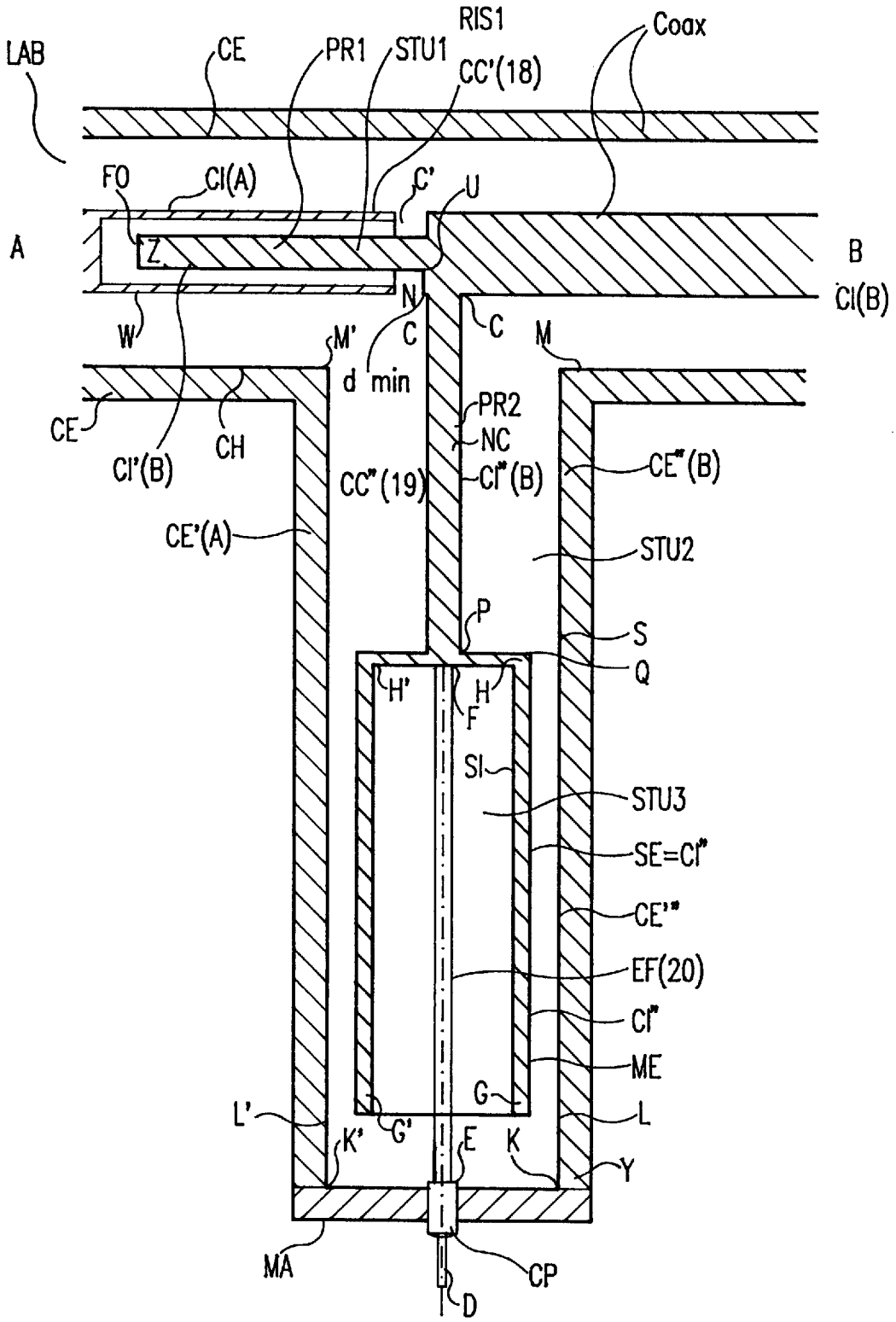
FIG. 8 is a simplified representation on an enlarged scale of the device of FIG. 7.

Referring to FIGS. 7 and 8, CE and CI indicate generally the outer and inner conductors of the RF coaxial line Coax between A and B.

The DC feed is introduced through a passing condenser CP located between the source D and the earth MA. The other end E of condenser CP is connected with the inner conductor EF(20) of co-axial stub STU3, provided inside an upturned, open-ended cylinder GHG'H', the outer cover ME of which acts as the inner conductor in the low impedance co-axial line. The outer conductor KLK'L' extends to meet in MM' the outer conductor of co-axial line Coax in which the radio-frequency RF signals travel.

The bottom of open-ended cylinder GHG'H is welded at P to a conductor NC soldered to C to the inner conductor CI of the co-axial line into which the biasing DC current is to be injected.

The inner conductor CI of the RF line between A and B is now considered as being divided in two parts AC' and CB, which are isolated from each other. The part AC' contains a cylindrical axial bore 18 (forming cavity CC'), the wall of which acts as an outer conductor of the low impedance, open-circuit stub STU1. The internal conductor is the continuation towards the left in FIG. 8 of the CB half of Coax, namely the protuberance PR1 of the inner conductor CI' (B) of branch B.

In the simplified scheme of FIG. 8 are clearly evidenced particular features, as follows:

Into the first cylindrical cavity CC' (18) inside the inner conductor CI(A) of the branch A co-axial line extends the protuberance PR1 (of the inner conductor CI' (B) of branch B) which has a length of $\lambda/4$ and forms the open circuit stub STU1 associated with branch B;

The inner conductor EF(20) of passing condenser CP associated to source D of the DC power enters the open-ended cylinder GHH'G' and is soldered to bottom F of the open-ended cylinder which is integral with a protuberance PR2 connected with inner conductor CI' (B) of the branch B co-axial line. The second protuberance PR2 is perpendicular to the first protuberance PR1 and develops into the inner conductor CI" (B) of short circuited stub STU2. Short circuit stub STU2 typically is produced by virtue of a third stub STU3 inside the open-ended cylinder GHH'G' and formed by the inner conductor EF(20) of the passing condenser CP and by the inner metallic surface SI of the open-ended cylinder.

The connection between the STU3 and the bottom of stub STU2 is realized by a co-axial line of which the inner conductor CI" is the outer surface SE of open-ended cylinder GHH'G' and the outer conductor CE"' is the extension of outer conductor CE" (B) of stub STU2 plus STU3 which serves to demonstrate that between Q (the open-ended cylinder outer vertex) and S (point on the inner surface of conductor CE" (B) facing Q) there is a low impedance.

According to a first feature of the invention, stub STU1 is open at the end W-Z. STU2 is also in series with the line having as internal conductor D-E-G-P-C and a capacitor Y-L-S-Q. In this way, condition 1 is satisfied, namely to make the STU2 impedance Z' op substantially equal to the STU1 admittance (Yos).

According to another aspect of the invention, the distance between the free ends facing the two stubs STU1 and STU2 is that between the points N and U and can readily be made the lowest possible, that is it can be kept between $\lambda/100$ and $\lambda/10$. In other words, and with reference to FIGS. 7 and 8, the inner conductor CI(B) of branch (B) shows two protuberances or projections PR1 and PR2. The first protuberance PR1 enters the first cavity CC' (18) within the inner conductor CI(A) of branch A of the co-axial line COAX. The second projection or protuberance PR2 enters a second cavity CC" (19) formed by the outer conductor CE of co-axial line Coax, more precisely by extensions CE' (A) and CE" (B) of branches A and D.

PR2 is $\lambda/4$ long, is welded to the bottom of the upturned open-ended cylinder GHG'H and develops into the inner conductor CI" of the second short circuited stub STU2 that is typically brought about by a third stub STU3 inside the GHG'H' open-ended cylinder and is formed by the inner conductor EF(20) of the passing capacity (CP) and of the inner metallic surface (SI) of the open-ended cylinder.

The connection between the third stub STU3 and the second stub STU2 is obtained with a coaxial line having as inner conductor CI", the outer surface SE of the GHG'H' open-ended cylinder, and as outer conductor CE"', the extension of the outer conductor CE" (B) of the second stub STU2.

A particularly advantageous application of the BIAS-T of FIGS. 7 and 8 according to the invention is that it can have very low dimensions compatible with miniaturized systems. As an example, in the case of tower mounted amplifiers (TMA) associated to a diplexer, and to small dipole antennas, it has been possible to integrate the BIAS-T device together with a lightning protector on a printed circuit plate.

While preferred embodiments of the invention have been shown and described herein, it is obvious that numerous omissions, changes and additions may be made in such embodiments without departing from the scope and spirit of the invention. Therefore, the present invention is to be limited not by the specific disclosure herein, but only by the appended claims.

We claim:

1. A DC bias device for a radio-frequency transmission system of high power and low intermodulation, the transmission system including an RF source of an RF signal with a central frequency corresponding to $\lambda$, a receiver for receiving the RF signal from the RF source on a coaxial line, and a DC source, direct current being fed by the DC source to the receiver, the device comprising:

a first coaxial branch connecting to the RF source and comprising an open-circuit stub having a first free head and a normalized characteristic admittance, and a second coaxial branch connection from the DC source to the receiver and comprising a short-circuit stub having a second free head and a normalized characteristic impedance; wherein the normalized characteristic impedance of the short-circuit stub of the second coaxial branch is substantially equal to the normalized characteristic admittance of the open-circuit stub, and wherein the free heads of the two stubs are disposed proximate one another and are separated from each other by a finite distance of less than $\lambda/20$.

2. DC bias device according to claim 1, wherein the finite distance between the free heads of the two stubs is less than or equal to $\lambda/100$.

3. DC bias device according to claim 1, wherein the finite distance is less than or equal to $\lambda/10$.

4. DC bias device according to claim 1, wherein the open circuit stub comprises a first stub comprising an inner conductor of the first coaxial branch having a cylindrical cavity within which a first protuberance of an inner conductor of the second branch extends, the first protuberance being $\lambda/4$ long and forming an open circuit with the open circuit stub of the first branch.

5. DC bias device according to claim 1, wherein the direct current source is connected to a passing condenser, an inner conductor of which enters an upturned open-ended cylinder and is joined to a closed end of the open-ended cylinder, the open-ended cylinder being integral with a second stub formed by a second protuberance connected to the inner conductor of the second branch of the coaxial line, the second protuberance being perpendicular to the first protuberance and forming the inner conductor of the short circuited stub, the short circuited stub also comprising a third stub being connected to the second stub and disposed inside the upturned open-ended cylinder, the third stub being formed by the inner conductor of the passing condenser and by an inner metallic surface of the open-ended cylinder.

6. DC bias device according to claim 5, wherein the connection between the third stub and the bottom of the second stub comprises a coaxial line having an inner conductor comprising an external surface of the open-ended cylinder and an outer conductor comprising an extension of an outer conductor of the second stub.

7. DC bias device according to claim 5, wherein the finite distance between the free heads of the two stubs is less than or equal to $\lambda/100$.

8. DC bias device according to claim 5 wherein the finite distance is less than or equal to $\lambda/10$.

9. DC bias device according to claim 5, wherein the open circuit stub comprises a first stub comprising an inner conductor of the first coaxial branch having a cylindrical cavity within which a first protuberance of an inner conductor of the second branch extends, the first protuberance being $\lambda/4$ long and forming an open circuit with the open circuit stub of the first branch.

* * * * *